US007378584B2

(12) United States Patent
Frank et al.

(10) Patent No.: US 7,378,584 B2
(45) Date of Patent: May 27, 2008

(54) DRUM

(76) Inventors: Beat Frank, Buttenenstrasse 16, Luzern (CH) CH-6006; Stefan Roosli, Zielmatte 15, Stansstad (CH) CH-6362

( * ) Notice: Subject to any disclaimer, the term of this patent is extended or adjusted under 35 U.S.C. 154(b) by 0 days.

(21) Appl. No.: 11/278,728

(22) Filed: Apr. 5, 2006

(65) Prior Publication Data

US 2006/0225559 A1 Oct. 12, 2006

(30) Foreign Application Priority Data

Apr. 9, 2005 (EP) ..... 05007846

(51) Int. Cl.
*G10D 13/02* (2006.01)

(52) U.S. Cl. ..... 84/411 R; 84/421

(58) Field of Classification Search ..... 84/411 R, 84/421; 248/443
See application file for complete search history.

(56) References Cited

U.S. PATENT DOCUMENTS 2,588,830 A * 3/1952 Haanstad ..... 84/421
4,102,237 A 7/1978 Suess et al.
4,634,032 A * 1/1987 LaFlame ..... 224/265

FOREIGN PATENT DOCUMENTS

DE 100 11 114 A1 10/2001

* cited by examiner

*Primary Examiner*—Kimberly Lockett
(74) *Attorney, Agent, or Firm*—Darby & Darby P.C.

(57) ABSTRACT

A drum cart (1) is provided for mounting and moving a drum (2). The cart included, a stand (3) mounted on two wheels (5). The stand is connected to the drummer by a hip strap. The drum (2) is held around its shell (7) by at least one bracket (6) and is preferably connected to the bracket (6) by two joints (8. The bracket (6) is preferably fastened to the stand (3). The drum is arranged in the stand so that the drummer beats the drum head (14) vertically with both beaters (10).

12 Claims, 4 Drawing Sheets

Fig. 4

| | | | | Drum cart | | Bass drum | Jazz bass drum | Kettle drum |
|---|---|---|---|---|---|---|---|---|
| | | | | 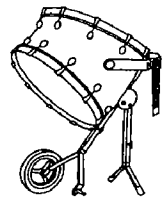 The invention | 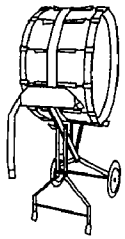 Gasser | 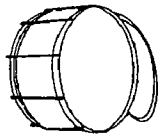 Duden Vol. 3 | 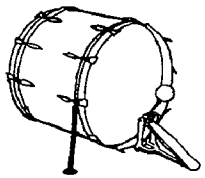 Duden Vol. 3 | 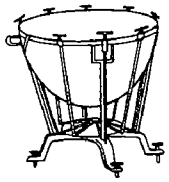 Duden Vol. 3 |
| | Feature | Pos. | | | | | | |
| F-1 | mobile | – | ● | ● | ● | ● | ○ | ○ |
| F-2 | clear forward vision | – | ● | ○ | ○ | ● | ● | ● |
| F-3 | stationary | – | ● | ● | ● | ● | ● | ● |
| F-4 | several instruments playable simultaneously | – | ● | ○ | ○ | ● | ● | ● |
| F-5 | beat vertically | – | ● | ○ | ○ | ○ | ● | ● |
| F-6 | beat on one side | – | ● | ○ | ○ | ● | ● | ● |
| F-7 | drum head on one side | 14 | ● | ○ | ○ | ● | ● | ● |
| F-8 | resonant skin | 15 | ● | ○ | ○ | ● | ○ | ○ |
| F-9 | support | 25 | ● | ● | ○ | ● | ● | ● |
| F-10 | hip belt | 4 | ● | ● | ○ | – | – | – |
| F-11 | without shoulder support | – | ● | ● | ○ | – | – | – |
| F-12 | reduced carrying load | – | ● | ● | ○ | ○ | ○ | ○ |
| F-13 | direct sound propagation to the drummer | 18 | ● | ○ | ○ | ● | ○ | ○ |
| F-14 | direct sound propagation to the public | 19 | ● | ○ | ○ | ● | ○ | ○ |
| F-15 | sitting possibility | 28 | ● | ○ | ○ | ○ | ○ | ○ |
| F-16 | robust mounting | 6 | ● | ○ | ○ | ● | ● | ● |
| F-17 | safe handling of the drum | 2x8 | ● | ○ | ○ | ○ | ● | ● |

Fig. 5

| | Feature | Pos. | Drum Cart | | | | |
|---|---|---|---|---|---|---|---|
| | | | 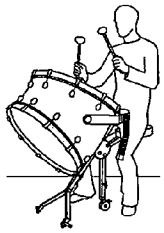 The invention | 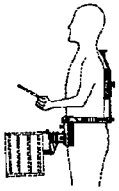 LaFlame | 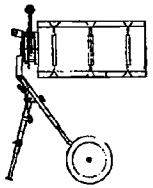 Bachle | 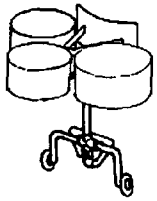 Suess | 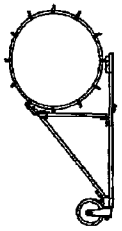 Haanstad |
| F-1 | mobile | – | ● | ● | ● | ● | ● |
| F-2 | clear forward vision | – | ● | ● | ● | ● | ○ |
| F-3 | stationary | – | ● | ○ | ● | ○ | ○ |
| F-4 | several instruments playable simultaneously | – | ● | ● | ● | ● | ○ |
| F-5 | beat vertically | – | ● | ● | ● | ● | ○ |
| F-6 | beat on one side | – | ● | ● | ● | ● | ○ |
| F-7 | drum head on one side | 14 | ● | ● | ● | ● | ○ |
| F-8 | resonant skin | 15 | ● | ● | ● | ● | ● |
| F-9 | support | 25 | ● | ○ | ● | ○ | ○ |
| F-10 | hip belt | 4 | ● | ○ | ● | ○ | ● |
| F-11 | without shoulder or back support | – | ● | ○ | ○ | ● | ○ |
| F-12 | reduced carrying load | – | ● | ○ | ● | ● | ● |
| F-13 | direct sound propagation to the drummer | 18 | ● | ● | ● | ● | ○ |
| F-14 | direct sound propagation to the public | 19 | ● | ○ | ○ | ○ | ○ |
| F-15 | sitting possibility | 28 | ● | ○ | ○ | ○ | ○ |
| F-16 | robust mounting | 6 | ● | ● | ○ | ○ | ○ |
| F-17 | safe handling of the drum | 2x8 | ● | ● | ○ | ○ | ○ |
| F-18 | suitable for a bass drum | – | ● | ○ | ● | ○ | ● |

DRUM

The present application claims the benefit of European Patent Application No. 05007846.8, filed Apr. 9, 2005.

BACKGROUND OF THE INVENTION

The invention relates to a drum cart for allowing the drummer to hold and move a bass drum.

The well known bass drum has a diameter of approximately 65 cm and a shell height of approximately 55 cm. The drum is covered with cattle skin, leather or a synthetic material, which is tensioned by a rope, as with tenor drums, or with hoops and clamping screws. The bass drum is of Ottoman origin and has been used since the $17^{th}$ century in military training and ceremonies, but particularly for marching into battle, for intimidating the enemy and raising the morale of the native troops, and us a privilege of the Janissary (an elite unit similar to the French Foreign Legion, recruited from Christian children taken from the enemy). Soon after their introduction, the exciting oriental music with the threatening tone of the bass drum, the wailing wind instruments and ringing cymbals conquered the courts of Europe and revitalized marching music. Further, it has been elevated into the Pantheon of classical music by the works of Mozart (Entführung aus dem Serail) and Haydn (Military Symphony).

In the Southern States of the United States of America, where the rhythmical folk music of the descendents of the once deported Africans flourished, the African drum music, intertwined with the marching and dance music of the European immigrants, developed into independent Jazz in the streets of $19^{th}$ century New Orleans. The itinerant street music later became ballroom and dance music and emerged as a stage attraction. With this, the bass drum of the jazz orchestra became the percussion and the central point of the orchestra. In the center of percussion, there is the resonant skin and a covered circular disc of the bass drum. The bass drum is set upright on the stage facing the public, and is surrounded by a fixedly assembled group of percussion instruments, e.g. a snare drum, several tom-toms and diverse single cymbals and a double cymbal. In this, the bass drum with the resonant skin covering, not only serves for the direct and effective exposure of the audience to sonic waves, but also for grabbing their attention and displaying the name of the orchestra. By way of a pedal known as a foot machine, the drummer kicks the drum head on one side of the bass drum and so leaves his hands free to sound the remaining percussion instruments.

A distant relative of the bass drum which is beaten on one side, is the kettle drum. The kettle drum is an instrument which arrived via central Europe from Asia in the $18^{th}$ century and has since become a classical musical instrument of military, operatic and symphony orchestras.

According to the above description, the bass drum is used to make music when stationary and on the move in processions, folk festivals and parades of all types. For marching, the bass drum, which weighs approximately 10 kg and is suspended by two straps around the shoulders of the drummer, is held against the stomach of the drummer. This forces the drummer to lean backwards when walking and standing due to the projection of the centre of gravity. In addition to the considerable strain on the spinal column, the back muscles and stomach muscles caused by the pressure and bending, the drum also restricts the forward vision of the drummer and blocks the necessary view of the ground or floor required for safe walking.

To reduce these disadvantages and make the instrument accessible to persons of a constitutionally less athletic make-up, the company Musikhaus Gasser of 6280 Hochdorf in Switzerland, proposed a chassis for holding and moving a bass drum. The chassis has two wheels and two rollers, and also a stomach plate and a hip strap for attaching the chassis to the drummer.

The disadvantage of this solution of the prior art is that, although it reduces the strain on the drummer, it has no effect on improving visibility.

SUMMARY OF THE INVENTION

The object of the present invention is to prevent the disadvantages of the Musikhaus Gasser attempted solution, and thus to

- ensure perfect visibility for the drummer; ;
- optimize the concept of acoustic radiation for street processions and stage performances and, at the same time,
- break with the traditional two-sided drumming technique in favour of downward drumming.

To achieve the improvements aimed at by the invention, the upright bass drum is first rotated through 90° about its axis of rotation. Then the drum is pivoted through approximately 25° with respect to the drummer and attached to a cart frame. By making the cart frame telescopic, the height of the drum head becomes adjustable so that any musician familiar with a downward beating technique is immediately capable of playing the bass drum.

The following is an incomplete selection of rhythm instruments which are played using the downward beating technique:

| | |
|---|---|
| Timpani | such as kettle drums |
| Skin drums | such as the snare drum and the tenor drum, the tom-tom, bongo, conga, timbale, tabla, surdo and darabukka |
| Wood celesta | such as the xylophone and marimbaphone |
| Metal celesta | such as the vibraphone and metallophone |
| Diaphones | such as suspended cymbals or hi-hat cymbals. |

The musical advantages of the invention are that it reduces the high demands of the traditional bass drum, for example, to the conventional measure of rhythm instruments with a downward drumming technique. When the traditional bass drum is beaten laterally, the sonic waves from the beaten drum head do not reach the drummer directly but only as a result of being reflected by the surrounding environment, for example from the front of houses in the case of street music. As a result, the drummer only receives feedback after a delay and with some degree of distortion, depending on the environment. Learning how to compensate for these deficiencies requires a great deal of practice and remains an individual feature of the quality of traditional drummers which, owing to the rhythmical leading role of the instrument, determines the musical quality of the entire orchestra.

Contrary to the traditional bass drum, the downwardly-beating drummer experiences direct acoustic feedback and therefore direct acoustic radiation itself. This direct acoustic information, which is free from delay and distortion, allows musicians who play instruments from above, problem-free access to the inventive arrangement of the bass drum, not the least because the drumming technique is identical. As a result, the complex interplay (refined through practice)

between the skins and the motor activity of the muscles and the joints (articulations!) are realized by moderate movements of the hand and arms.

Because the originally vertical plane-parallel drum skins of the bass drum are aligned virtually horizontally in the invention and are inclined with respect to the drummer, the sound from the resonant skin would radiate at a steep angle to the ground or floor. By rotating the resonant skin, however, the acoustic radiation from the floor is flatter and therefore, as with the jazz drum, the radiation of the sound in the marching direction or on the stage is directed towards the public, which is of considerable advantage when compared to the upright bass drum of the prior art.

The drum cart of the invention can be converted from a mobile to a stationary configuration with a few handles, a support which can be pivoted outwards, and a castor or a support pad. This is of considerable advantage since, depending on the situation, the drummer is able to play without having to carry the drum cart and therefore without having to wear the hip strap. As a result, the use of the parking brakes of the castors determines whether the mobility of this configuration is utilized or restricted.

To the further advantage of the invention, the rigidity of the configuration can be increased for stationary use in that, by removing the wheels, it is possible to convert to using the support pad. In this connection, the possibility of integrating a push-on seat should also be mentioned as a further advantage.

An additional advantage of the invention is that it comprises elements which can be folded and dismantled and which, with the exception of the drum, can therefore be accommodated in a carry box and are therefore convenient from a time-based logistical perspective.

BRIEF DESCRIPTION OF THE DRAWINGS

The invention is illustrated with its essential parts below according to an exemplary embodiment in mobile and stationary use, wherein:

FIGS. 4 and 5 show a comparison of the features of the drum cart according to the present invention with the above-mentioned prior art.

DETAILED DESCRIPTION OF EXEMPLARY EMBODIMENTS

Figure 1:
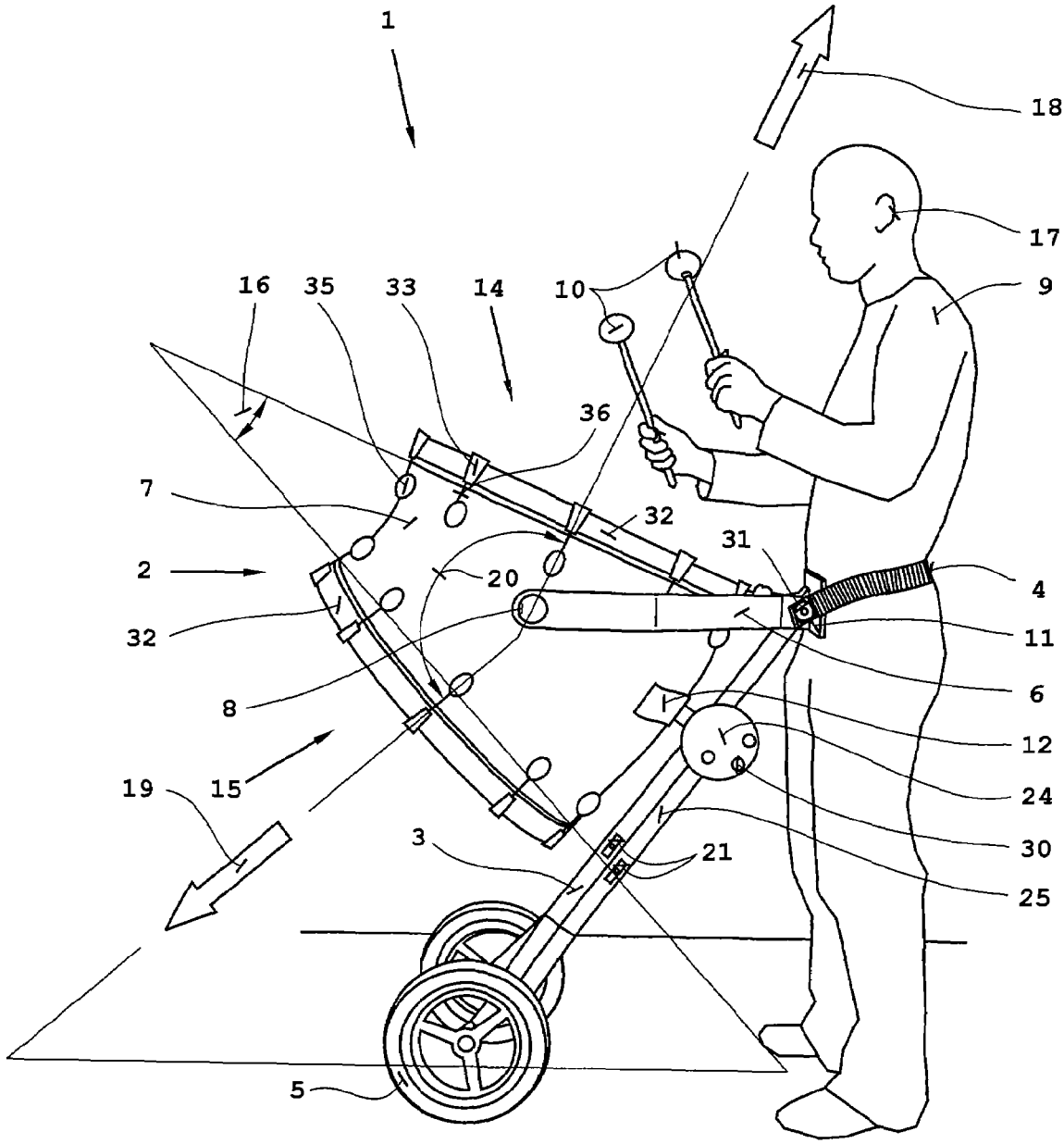
FIG. 1 shows the drum cart according to the present invention in mobile use.

FIG. 1 shows the drum cart 1 with the bass drum 2 which is supported on the stand 3 by the frame saddle 12 and is held by the bracket 6 with the joints 8. The drum is covered with the drum head 14 and resonant skin 15 (not visible in FIG. 1) with the aid of the hoops 32, the clamping screws 36, the clamping blocks 35 seated on the shell 7 and catches 33 on the hoops 32. The stand rests on wheels 5 and is attached to the drummer 9 using the support or stomach plate 11 and the hip strap 4. Since the stand 3 is telescopic, the required position of the stomach plate 11 can be adjusted according to the body size of the drummer 9 and fixed by the pins 21. Owing to this construction, the two hands of the drummer 9 are free so that he is able to play with both beaters 10 on the drum 2 when standing or walking. During this, the drummer 9 hears through his ears 17 what he is playing directly, since the acoustic radiation from the drum head 14 corresponds directly to the resultant forces 18, and are directed toward his ears. Since the shell 7 of the drum 2 is segmented or curved such that, instead of the otherwise conventional plane-parallel arrangement of the drum skins 14, 15 of the bass drum 2, they are inclined with respect to each other according to the angle 16, the acoustic radiation 19 is reflected obliquely in the marching direction.

Figure 3:
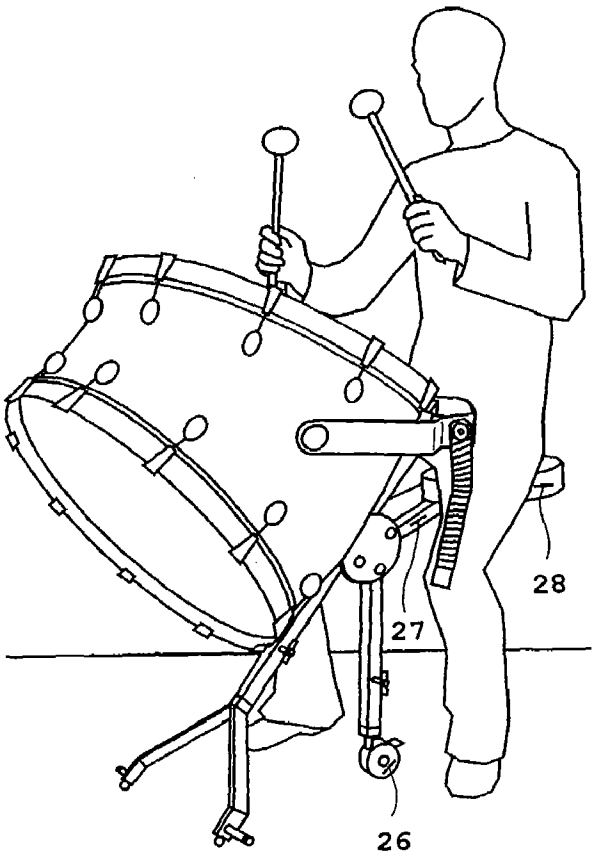
FIG. 3 shows the drum cart according to the present invention in stationary use.
Figure 2:
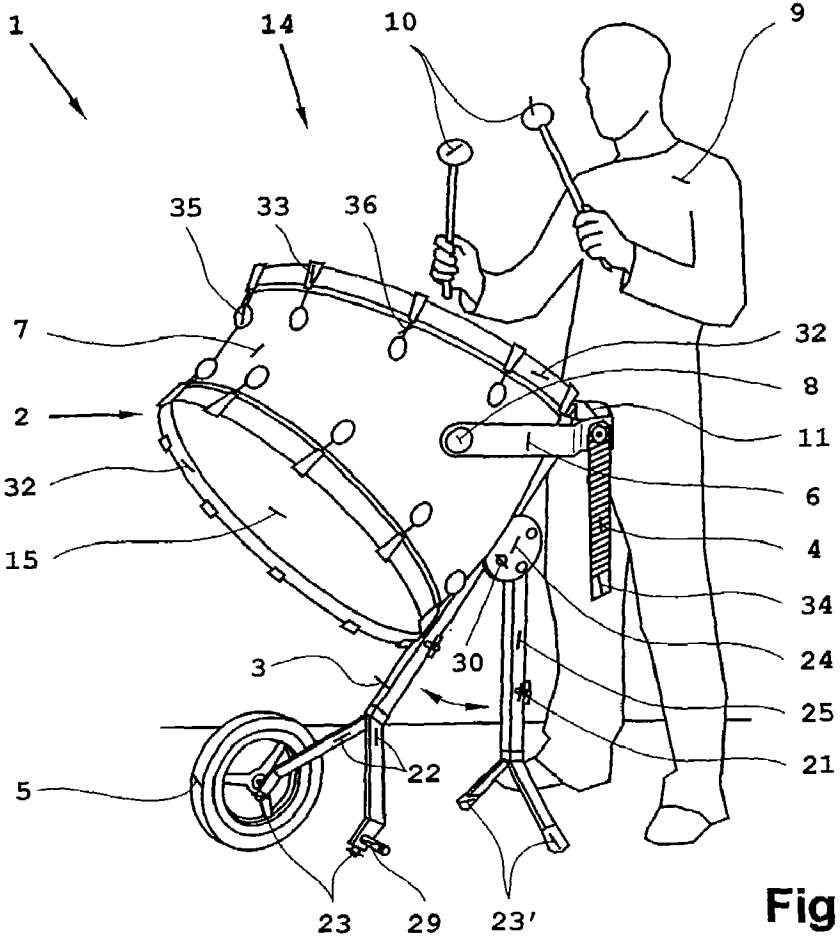
FIG. 2 shows the drum cart according to the present invention in provisional stationary use.

If stopping for a while, the drummer 9 can release the catch 30 with a cord which ends between the drum 2 and the stomach plate 11 (and is therefore not visible), so that the support 25 is pivoted into the position shown in FIGS. 2 and 3 thanks to the release of a spiral spring in the joint 24, so that the drummer 9 can extricate himself from the drum cart 1 without outside help and can release the buckle 34 on the hip strap 4.

The support 25 can be equipped as required with a foot having support pads 23' or a castor 26 with integrated parking brake.

To close the extended support 25 according to FIG. 1, the drummer has to grasp the drum cart 1 by the bracket 6 and pull it towards him, in opposition to the normal direction of travel, until the drum is supported by stand 3 alone, support 25 collapses and the drum cart 1 is no longer supported on the ground by way of the support 25. The support 25 is then pulled against the stand 3 until the catch 30 clicks and holds the clamped support 25 in the closed position.

FIG. 3 shows the rigid configuration of the drum cart 1 according to the stationary use without wheels 5, in which case the stand 3 is supported on the support pads 23 of the forked portion 22 (c.f. FIG. 2) and the roller 26, instead of on the wheels 5, and the drummer 9 (c.f. FIG. 2) sits on a saddle 28 which can be pushed with the support piece 27 into the support joint 24.

FIGS. 4 and 5 show features M-1 through M-14 in a table. While the table shows that each of these features is provided by the present invention, the prior art fails to exhibit each rich feature.

While the invention has been particularly shown and described with reference to preferred embodiments thereof, it will be understood by those skilled in the art that various changes in form and details may be made therein without departing from the spirit and scope of the invention.

The invention claimed is:

1. A drum cart and drum allowing a drummer to hold and move a bass drum having a shell with two open ends and a drum head over one of the open ends of the shell and a resonant skin over the other open end of the shell, comprising:

a stand upon which the drum rests so that the plane of its drum head is directed toward the drummer and is not vertical, two wheels mounted to the bottom of the stand, a stomach plate mounted to the top of the stand and adapted to contact the stomach of the drummer, a hip strap adapted to surround the hips of the drummer and to be fastened to the stomach plate, and a shell for the drum such that the plane of the drum head is at an angle to the plane of the resonant skin, whereby the drummer may beat the drum head from above when walking, standing or sitting.

2. A drum cart according to claim 1 further including at least one bracket connected between the shell of the drum and the stand by at least one joint.

3. A drum cart according to claim 1, wherein the plane of the drum head when mounted in the stand is positioned such that the direct acoustic radiation from the drum head is directed toward the ears of the drummer.

4. A drum cart according to claim 1, wherein an angle between the acoustic radiation from the drum head and the acoustic radiation from the resonant skin is less than 180°.

5. A drum cart according to claim 1, wherein the stand is telescopically adjustable and can be locked in a telescoped position by a pin.

6. A drum cart according to claim 1, wherein the lower end of the stand terminates in a forked portion.

7. A drum cart according to claim 6, wherein the wheels may be removably mounted on the forked portion.

8. A drum cart according to claim 6, wherein the forked portion ends in support pads.

9. A drum cart according to claim 1, further including a pivotable support connected to the stand by a support joint.

10. A drum cart according to claim 9, wherein the support ends in one of a castor and a support pad.

11. A drum cart according to claim 1, further including a pivotable and lockable support piece extending from the stand toward the drummer and a saddle connected to the support joint upon which the drummer may sit.

12. A drum cart according to claim 1, further including a telescopic support connected to the stand by a support joint.

* * * * *